US008484999B2

(12) United States Patent
Classen et al.

(10) Patent No.: US 8,484,999 B2
(45) Date of Patent: Jul. 16, 2013

(54) WATER-CONDUCTING DOMESTIC APPLIANCE COMPRISING AN EXPANSION OPENING

(75) Inventors: Egbert Classen, Wertingen (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 961 days.

(21) Appl. No.: 12/311,094

(22) PCT Filed: Aug. 29, 2007

(86) PCT No.: PCT/EP2007/058959

§ 371 (c)(1),
(2), (4) Date: Sep. 28, 2009

(87) PCT Pub. No.: WO2008/034690

PCT Pub. Date: Mar. 27, 2008

(65) Prior Publication Data

US 2010/0043852 A1 Feb. 25, 2010

(30) Foreign Application Priority Data

Sep. 19, 2006 (DE) ..... 10 2006 043 917

(51) Int. Cl.
*D06F 29/00* (2006.01)
*D06F 35/00* (2006.01)

(52) U.S. Cl.
USPC ..... 68/17 R; 134/56 D

(58) Field of Classification Search
USPC ..... 68/17 R; 134/56 D
See application file for complete search history.

(56) References Cited

U.S. PATENT DOCUMENTS

| | | | | |
|---|---|---|---|---|
| 4,064,888 | A | 12/1977 | Diebel | |
| 2002/0088502 | A1 | 7/2002 | Van Rompuy et al. | |
| 2005/0126608 | A1* | 6/2005 | DeWeerd et al. | 134/56 D |
| 2005/0155633 | A1* | 7/2005 | Daume et al. | 134/25.2 |
| 2007/0144558 | A1 | 6/2007 | Classen et al. | |

FOREIGN PATENT DOCUMENTS

| | | |
|---|---|---|
| DE | 1816003 | 8/1970 |
| DE | 3805084 A1 | 8/1989 |
| DE | 3842639 A1 | 6/1990 |
| DE | 102005061801 A1 | 6/2007 |
| GB | 1543781 | 4/1979 |

OTHER PUBLICATIONS

Jerg et al., Aug. 1989, DE 3805084A1, English machine translation.*
Wildbrett, Johann: Technologie der Reinigung im Haushalt, Stuttgart 1981, S. 207, ISBN 3-8001-2121-2.

* cited by examiner

*Primary Examiner* — Michael Barr
*Assistant Examiner* — Jason Ko
(74) *Attorney, Agent, or Firm* — James E. Howard; Andre Pallapies

(57) ABSTRACT

A water-conducting domestic appliance, in particular a domestic dishwasher, the water-conducting domestic appliance including a washing compartment for receiving items therein that are to be subjected to a handling process by the water-conducting domestic appliance; and a detergent dosing system, the detergent dosing system having a detergent dispenser, the detergent dispenser being configured to receive at least one cartridge that is configured to hold a dosing agent, the detergent dosing system being configured to communicate the washing compartment and an area surrounding the water-conducting domestic appliance with one another in the manner of an expansion opening via which a fluid under pressure in the washing compartment can be released to the area surrounding the water-conducting domestic appliance.

16 Claims, 3 Drawing Sheets

WATER-CONDUCTING DOMESTIC APPLIANCE COMPRISING AN EXPANSION OPENING

BACKGROUND OF THE INVENTION

The invention relates to a water-conducting domestic appliance in accordance with the preamble of claim 1.

For example, dishwashers usually have a pressure-regulating means, which provides a pressure balance when an excess pressure occurs in the washing container. The pressure-regulating means can for example be embodied as a valve. In the case of an excess pressure, for example due to a so-called expansion jolt, the pressure-regulating means can open, whereby the pressure resulting inside the washing container is released. This pressure-regulating means also designated as the appliance ventilation is usually connected to a conduit system, which is connected to the washing container. In particular, the introduction of a special opening into the washing container intended for the pressure-regulating means is, however, undesirable from a production point of view as well as for cost reasons.

BRIEF SUMMARY OF THE INVENTION

The object underlying the present invention is thus to simplify further the constructive structure of a water-conducting domestic appliance. Furthermore, it is the object of the invention to make provision for a corresponding detergent dosing system.

This object of the invention is achieved by means of a water-conducting domestic appliance in accordance with the features of claim 1. Advantageous embodiments are the subject matter of the dependent claims.

In the case of a water-conducting domestic appliance, in particular a domestic dishwasher, comprising a washing compartment and a detergent dosing system, the detergent dosing system is designed to create an expansion opening between the washing compartment and the surrounding area for the embodiment of an expansion opening in accordance with the invention. In this process, the detergent dosing system can be embodied to be fitted next to the washing compartment of the dishwasher inside the dishwasher. The detergent dosing system is embodied for receiving at least one detergent, it being possible that the amount of detergent that can be held is greater than the amount required for a washing cycle. In essence, the detergent dosing system makes provision for the exact amount of detergent required for a washing cycle. Detergents can be compounds of detergent components or of individual detergent substances such as for example an enzyme. The detergents can be in the form of a liquid or a gel. The detergents can be held in a plurality of chambers in the cartridge. In addition, provision can also be made that the detergent dosing system for receiving a corresponding number of cartridges is embodied with only one chamber.

The integration of the expansion opening into a detergent dosing system has the advantage that the washing container of the dishwasher can be constructed in a simpler manner. In particular, it is now no longer necessary to have to make provision for separate openings for providing an expansion opening and for integrating a supply device or a detergent dosing system. Accordingly, production steps can be omitted whereby the result of this is that a more cost-effective dishwasher can be made available. In particular, the conduit guidance is simplified by this, as it can be of a shorter distance compared with that of conventional dishwashers. By reducing the openings to be introduced into the washing container, the number of openings to be sealed is also reduced.

The detergent dosing system can be connected to a conduit system in a preferred manner, which creates a connection to an area surrounding the dishwasher. The conduit system for example runs in a well known way in the intermediate space running between the washing container and an outer wall of the dishwasher.

In order to create the functional connection between the washing compartment and the surrounding area for the embodiment of the expansion opening, the detergent dosing system in accordance with a further embodiment has at least one opening facing the washing compartment. This opening preferably opens into a chamber of the detergent dosing system, which has been provided for receiving solid detergents, it being possible that the at least one chamber creates the functional connection between the washing compartment and the surrounding area.

Providing a chamber for a solid detergent has the advantage that the operation of the dishwasher can also be ensured when the detergent that is usually filled into the detergent dosing system, which can for example be held in a cartridge, is running short and the owner no longer has another filled cartridge to hand. Over and above that, the design is simplified because the opening that forms the functional connection between the washing compartment and the surrounding area need not be supplied with a separate cover such as for example a lid. The ingress of water into the opening can only be taken into consideration by means of the constructive embodiment or the arrangement of the opening in the chamber.

In order to be able to make the functionality of the expansion opening available at any time, it is expedient if the at least one chamber is not sealed by means of a sealing element such as for example a lid.

The detergent dosing system is arranged in accordance with a variant in a side wall of the washing compartment, for example between an upper basket and a lower basket of the dishwasher. Because of this, the filling of the detergent dosing system with detergents and, if required, other operating substances is made easier for the user, for example, when the door is open. However, different positions for the detergent dosing system are also possible, such as for example a rear wall or a cover of the washing compartment.

A further embodiment makes provision for the fact that the detergent dosing system has a detergent dispenser with at least one receiving compartment for at least one cartridge, which in an operating state, for example, when the door is open can be inserted in the receiving compartment. For this reason, the detergent dosing system comprises as the main component, a detergent dispenser that is arranged in the dishwasher in a permanent manner as well as at least one detergent-containing cartridge, i.e. a cartridge can contain only one detergent supplied in this way in the chamber or in a plurality of chambers for comprising a corresponding number of detergents. In this process, the detergents can be individual cleaning substances or combination products of cleaning substances. The cartridge preferably has at least two chambers, one for a detergent and the other one for a rinsing agent. Supplying the detergent by means of the cartridge makes handling easier for the user.

In addition, provision has preferably been made for a device which detects the occupancy of the at least one chamber with a solid detergent and sends a signal that identifies this status to a controller of the dishwasher. Because of this, a correct function sequence of the dishwasher is ensured when the user has put detergent into the chamber. Because of this, there is no need for the user of the dishwasher to become concerned about whether or not a corresponding washing program has been selected for controlling the cartridge or the chamber.

As an alternative, provision can be made so that a user can select whether or not detergent should be added via the cartridge or whether a solid additive in the at least one chamber should be used. This variant requires a selector switch, which can for example be integrated in a control element of the dishwasher. On the other hand, a corresponding sensor element for detecting whether or not the chamber is filled with a solid additive can be dispensed with.

The detergent dosing system has at least one outlet that is in a functional connection with the washing compartment through which a predetermined amount of detergent can be supplied to the washing mixture during a washing cycle. Provision can be made for the at least one outlet at the detergent dispenser. It is also feasible that the at least one outlet is arranged on the cartridge. It is expedient if provision is made for the at least one outlet at the housing section of the detergent dispenser, which is arranged in the direction of gravity below the receiving compartment. In principle, the number of outlets is arbitrary. Provision can be made for a number of outlets, which correspond to the numbers of detergents held in the cartridge or the number that corresponds to the chambers of the cartridge holding the detergent. The latter variant prevents detergent components from mixing in a single outlet to a disadvantageous or unprecedented effect in the detergent mixture.

In accordance with a further embodiment, the at least one outlet of the detergent dosing system opens into a dosing chamber, which is connected to the detergent in a functional manner. This comprises in accordance with one embodiment, a feeding device by means of which the detergent can be fed from the cartridge into the washing container.

BRIEF DESCRIPTION OF THE DRAWINGS

The invention is described in more detail below with reference to the figures, in which.

DETAILED DESCRIPTION OF THE PRESENT INVENTION

Figure 1:
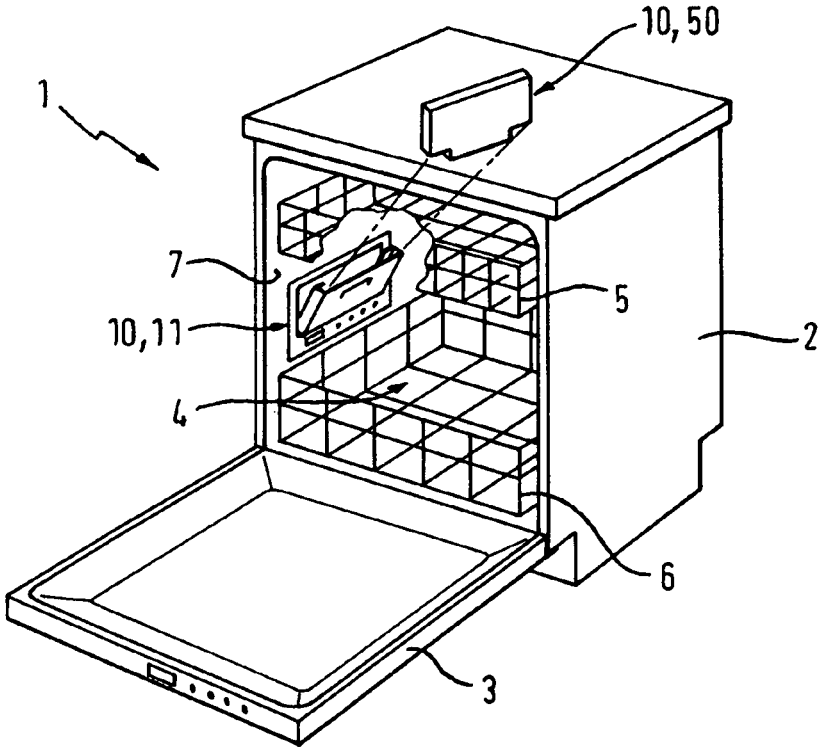
FIG. 1 shows a dishwasher in accordance with the invention with a detergent dosing system, which is arranged in a container wall.

FIG. 1 shows a dishwasher I in accordance with the invention, which has a door 3 that is fitted so that it can be hinged on a housing 2. In the drawing, the door 3 is shown in its open position. In a washing compartment 4 that can be closed off by means of the door 3, crockery washing baskets 5, 6 are arranged in a well-known manner. A detergent dosing system 10, comprising a detergent dispenser 11 and a cartridge 50, which contains at least two detergents held separately from one another, is arranged in a container wall 7 of the housing 2. In this way, FIG. 1 shows the preferred arrangement of the detergent dosing system 10 between the upper basket 5 and the lower basket 6. In this process, the detergent dispenser 11 receiving the cartridge 50 is arranged in a section of the container wall 7 near the door opening, in order to facilitate the insertion and the removal of the cartridge 50 into or from the detergent dispenser 11 for the user.

Figure 3:
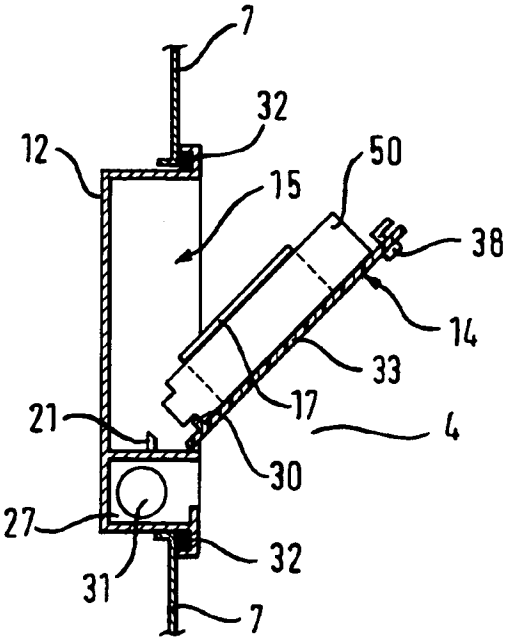
FIG. 3 shows a cross-sectional view through the detergent dosing system shown in FIG. 3.
Figure 2:
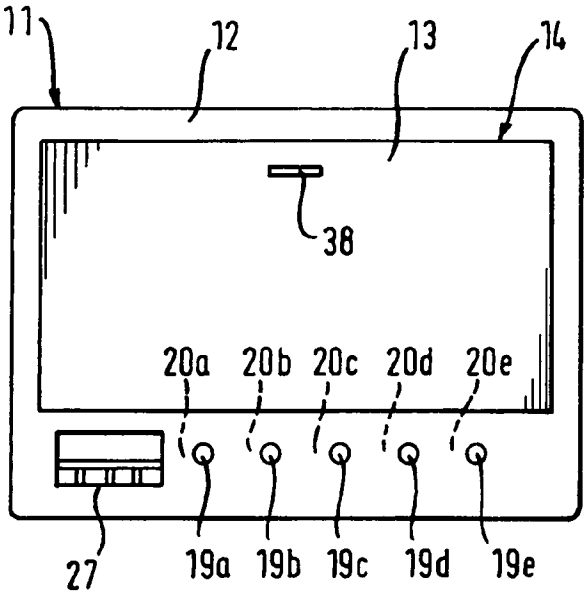
FIG. 2 shows a top view of a detergent dosing system in accordance with the invention for the arrangement in the container wall of the dishwasher.

FIGS. 2 and 3 show a top view of and a cross-sectional view through the detergent dosing system 10, in the same way as it is used in the dishwasher in accordance with FIG. 1. FIG. 2 shows the detergent dispenser 11 arranged in the container wall. This includes a housing 12 and a lid 14 that is fitted in a hinged manner to the housing 12. If the lid 14, as shown in FIG. 3, is in its opening position, then the cartridge 50 can be inserted into the lid 14 via the washing compartment 4. The lid 14 has, for purposes of mounting and fixing, two symmetrically arranged retaining flaps 17 in an L-shape and which are adapted to the size of the cartridge 50, so that the retaining flaps 17 grip the cartridge 50 after its insertion. In addition, at lid 14 a bearing surface 30 is formed so that the cartridge 50 lies in a defined position. By closing the lid 14, the cartridge is inserted into a receiving compartment 15 of the detergent dispenser 11 and, if necessary, pressed by means of existing lugs and/or projections against the housing of the detergent dispenser into its final position.

As can clearly be seen from the cross-sectional view in FIG. 3, the outer circumference of the housing 12 of the detergent dispenser 11 comprises a fold. The fold serves to receive a seal 32, which is inserted between the fold and the container wall 7. In this way, the ingress of water or the penetration of moisture towards the back of the container wall 7 is prevented.

In addition to receiving the cartridge, the detergent dispenser 11 has a chamber 27 for receiving a solid detergent. A solid detergent can for example be a 3-in-1 tablet, which is placed in the chamber 27 when there is no cartridge or an empty cartridge 50 in the receiving opening 15. The provision of the chamber 27 for receiving a solid detergent also makes it possible to use the dishwasher when the cartridge 50 is empty and a filled cartridge is not available.

The chamber 27 has, as can be seen in FIG. 3, an opening 31, which is connected to the area surrounding the dishwasher. For this purpose, the opening 31 can be connected to the surrounding area via channels not shown in the figures running at the back of the container wall 7. For this reason, the detergent dosing system integrates the functionality of a so-called "expansion opening", which serves to release the excess pressure developing in the washing compartment, when the dishwasher is for example opened and then again closed by the user during a washing cycle with a washing mixture that has already been heated. The excess pressure resulting at this exact moment can then be released via the chamber 27 and the opening 31 to the surrounding area.

By integrating the expansion opening into the detergent dosing system and the possibility of making available all detergents and resources for the operation of the dishwasher by means of the detergent dosing system, there is in essence a more simple constructional structure compared with that of conventional dishwashers. In particular, provision also has to be made for only one opening for the detergent dosing system 10 in the washing container of the dishwasher. Further openings, which have thus far been necessary for making available the expansion opening and/or the supply device, may therefore be omitted. As a result, the manufacturing process of the dishwasher can be effected with fewer steps. In addition, there is no longer a need to provide each of the openings for one of the above-mentioned functional parts with a costly seal. On the whole, it is thus possible to manufacture a more inexpensive dishwasher.

Figure 4:
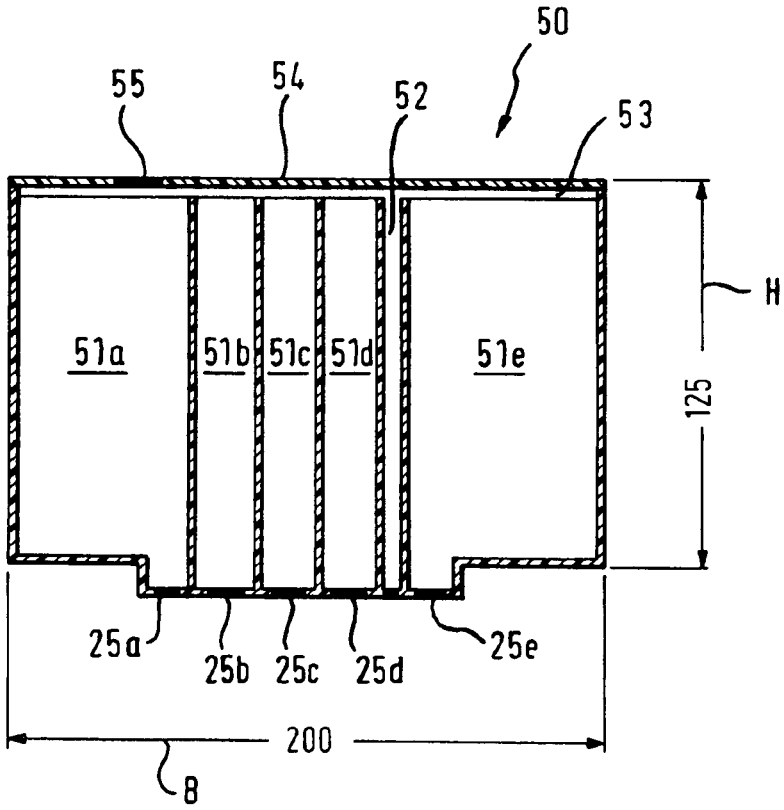
FIG. 4 shows an exemplary embodiment of a cartridge for use in a detergent dosing system in accordance with the invention.

An exemplary embodiment of cartridge 50 is shown in FIG. 4. By way of example, the cartridge 50 only has five chambers 51*a*, 51*b*, 51*c*, 51*d* and 51*e*, for receiving a detergent or a detergent mixture in each case. In this process, the size of the individual chambers 51*a* to 51*e* is preferably dimensioned according to the volumes necessary during a given number of washing cycles. The volume of the different detergents in chambers 51*a* to 51*e* is preferably calculated in such a way that after a certain number of washing cycles, preferably between 20 and 40, more preferably approximately 30, all the chambers 51*a* to 51*e* are completely emptied. Each of the chambers 51*a* to 51*e* is provided with a seal 25*a* to 25*e* that can open, for example in the form of a membrane. The membrane, for example consisting of rubber, seals off the individual chambers 51*a* to 51*e* so that during the storage and the transportation of the cartridge 50, no detergent can escape from said cartridge. When inserting the cartridge 50, into the detergent dispenser 11, the membranes of channels 21 correspondingly arranged in the detergent dispenser 11 (cf. FIG. 3) are pierced so that according to the stipulations for a corresponding dosing device, detergent can be supplied to the washing compartment.

The cartridge is preferably made of a plastic and has a width B of approximately 200 mm, a height H of approximately 125 mm, and a depth of approximately 25 mm. With these dimensions, the volume of the different chambers can be dimensioned in such a way that the desired 20 to 40 washing cycles can be carried out by means of one cartridge. In addition to chambers 51*a* to 51*e*, the cartridge 50 has an additional chamber 52, which is connected to one or a plurality of ventilation channels 53. The one ventilation channel or the plurality of ventilation channels 53 on their part are connected to the different chambers 51*a* to 51*e*. In this way, it is ensured that with an increasing emptying of chambers 51*a* to 51*e*, no negative pressure can build up inside these chambers, as a result of which the addition of detergents would be hindered or distorted. The ventilation channels 53 are preferably located in a lid 54, which is attached to the housing of the cartridge after the individual chambers 51*a* to 51*e* have been filled with the specific detergents. The lid 54 can have a relief valve 55, which is, if required, needed for certain detergent components.

Because the detergent contained in the cartridge 50 is added only gradually as part of a plurality of washing cycles to the washing compartment, more specifically the washing mixture that is circulated in the washing compartment, it is subjected to considerable absolute temperatures and temperature fluctuations with each washing cycle. In order to prevent the properties of the detergent from changing over time on account of the above, at least a housing wall 13 of a cartridge 50 facing the washing compartment and/or a lid 14 of the detergent dosing system 10 facing the washing compartment is made of insulating material or is covered with an insulation 33. As a result of this, a heat flow from the washing compartment towards the detergent dosing system or the detergent in the cartridge is limited, so that the long-term stability of the detergent used is guaranteed. The insulation 33 can be formed by a means of a gas volume in the lid or in the relevant housing section of the cartridge. Said gas volume producing the insulation can be introduced as part of the manufacturing process of the lid or the cartridge. The method used in this case is known as the gas internal-pressure process (GID).

In addition, in a housing 12 of the detergent dispenser 11, provision has been made for outlets 19*a* to 19*e*. The outlets 19*a* to 19*e* in each case open into a dosing chamber 20*a* to 20*e*. The dosing chambers are in each case connected via the channels to an assigned chamber of the cartridge.

In each of the dosing chambers, a feeding device that is not shown in more detail is arranged, which brings about the feeding of a predetermined amount of detergent into the washing compartment.

In this process, the detergent can be fed either exclusively by using the force of gravity. However, the feeding device can also be designed in accordance with the principle of a pump, so that by means of a correspondingly negative pressure, detergent is fed from the cleaning chamber into the dosing chamber and is pumped with corresponding excess pressure from the dosing chamber 20*a* into the washing compartment.

LIST OF REFERENCE CHARACTERS

1 Dishwasher
2 Housing
3 Door
4 Washing compartment
5 Crockery washing basket
6 Crockery washing basket
7 Container wall
8 Front of door
10 Detergent dosing system
11 Detergent dispenser
12 Housing
13 Housing wall (=lid)
14 Lid
15 Receiving compartment
16 Holding device
17 Retaining flap
19*a*-19*e* Outlet
20*a*-20*e* Dosing chamber
21*a*-21*e* Channel
25*a*-25*e* Membrane
27 Chamber for solid detergent (tablet)
30 Limit stop/bearing surface
31 Opening (to the surrounding area)
32 Seal
33 Insulation
50 Cartridge
51*a*-51*e* Chamber for detergent
52 Chamber for ventilation
53 Ventilation channel
54 Lid
55 Relief valve
H Height
B Width

The invention claimed is:

1. A water-conducting domestic appliance, comprising:

a washing compartment to receive items to be washed by the water-conducting domestic appliance; and a detergent dosing system arranged in an interior wall of the water-conducting domestic appliance, having each of a detergent dispenser with a receiving space configured to receive at least one removable cartridge containing at least a first detergent, and a chamber that is separate from the receiving space; wherein the detergent dispenser is configured to dispense the at least a first detergent to an interior of the water-conducting domestic appliance during a wash operation; and the chamber that is separate from the receiving space:

(i) is configured to hold and dispense a second detergent through a second detergent outlet to an interior of the water-conducting domestic appliance during a wash operation, and (ii) includes an expansion opening to release excess pressure in the washing compartment through the second detergent outlet to the surrounding of the water-conducting domestic appliance when a door of the water-conducting domestic appliance is in a closed position.

2. The water-conducting domestic appliance according to claim 1 wherein the detergent dosing system connects to a conduit system for the release of excess pressure in the washing compartment to the surrounding of the water-conducting domestic appliance.

3. The water-conducting domestic appliance according to claim 1 wherein the detergent dosing system includes at least one opening facing the washing compartment.

4. The water-conducting domestic appliance according to claim 3 wherein the second detergent is a solid detergent and the at least one opening opens into the at least one chamber.

5. The water-conducting domestic appliance according to claim 4 wherein the chamber that is separate from the receiving space is open.

6. The water-conducting domestic appliance according to claim 1 wherein the detergent dosing system is disposed between an upper basket and a lower basket.

7. The water-conducting domestic appliance according to claim 1 wherein the detergent dispenser comprises at least one receiving compartment for the at least one removable cartridge.

8. The water-conducting domestic appliance according to claim 1 wherein the first detergent is one of a liquid and a gel.

9. The water-conducting domestic appliance according to claim 4 further comprising a device that detects a filling of the chamber that is separate from the receiving space with the solid detergent and sends a signal indicating this status to a controller of the water-conducting domestic appliance.

10. The water-conducting domestic appliance according to claim 4 further comprising a selector switch, wherein the water-conducting domestic appliance is configured for user selection, via the selector switch, of whether the first detergent or the second detergent is added to the washing compartment.

11. The water-conducting domestic appliance according to claim 1 wherein the detergent dosing system has at least one outlet to the washing compartment through which a predetermined amount of at least one of the first and second detergent is supplied to the washing compartment during a washing cycle.

12. The water-conducting domestic appliance according to claim 11 wherein the at least one outlet is formed at a lower part of a housing section of the detergent dispenser so that the first detergent agent is gravity-fed to the washing compartment.

13. The water-conducting domestic appliance according to claim 11 wherein the at least one outlet opens into a dosing chamber.

14. The water-conducting domestic appliance according to claim 1, further comprising at least one feeding device by means of which the first detergent agent is fed from the at least one removable cartridge.

15. The water-conducting domestic appliance of claim 1, wherein the water-conducting domestic appliance is a domestic dishwasher.

16. A detergent dosing system for a washing compartment of a water-conducting domestic appliance, the detergent dosing system comprising:

a detergent dispenser arranged inside of a water-conducting domestic appliance and configured to dispense, from a removable cartridge inserted into a receiving space in the water-conducting domestic appliance, at least a first detergent to an interior of the water-conducting domestic appliance during a wash operation; and a chamber that is separate from the receiving space; wherein the chamber that is separate from the receiving space:

(i) is configured to hold and dispense a second detergent through a second detergent outlet to an interior of the water-conducting domestic appliance during a wash operation, and, (ii) includes an expansion opening to release excess pressure in the washing compartment through the second detergent outlet to a surrounding of the water-conducting domestic appliance when a door of the water-conducting domestic appliance is in a closed position.

* * * * *

UNITED STATES PATENT AND TRADEMARK OFFICE

CERTIFICATE OF CORRECTION

PATENT NO. : 8,484,999 B2
APPLICATION NO. : 12/311094
DATED : July 16, 2013
INVENTOR(S) : Classen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1155 days.

Signed and Sealed this
Eighth Day of September, 2015

Michelle K. Lee

Michelle K. Lee
*Director of the United States Patent and Trademark Office*